US005809149A

United States Patent [19]

Cashion et al.

[11] Patent Number: 5,809,149

[45] Date of Patent: Sep. 15, 1998

[54] APPARATUS FOR CREATING 3D AUDIO IMAGING OVER HEADPHONES USING BINAURAL SYNTHESIS

[75] Inventors: Terry Cashion; Simon Williams, both of Calgary, Canada

[73] Assignee: QSound Labs, Inc., Alberta, Canada

[21] Appl. No.: 719,631

[22] Filed: Sep. 25, 1996

[51] Int. Cl.[6] ..... H04S 5/00

[52] U.S. Cl. ..... 381/17; 381/25

[58] Field of Search ..... 381/17, 25

[56] References Cited

U.S. PATENT DOCUMENTS 5,371,799 12/1994 Lowe et al. ..... 381/25

5,436,975 7/1995 Lowe et al. ..... 381/17

*Primary Examiner*—Forester W. Isen

*Attorney, Agent, or Firm*—Fulbright & Jaworski L.L.P.

[57] ABSTRACT

An apparent location of a sound source is controlled in azimuth and range to a listener of the sound using headphones by a range control block that has variable amplitude scalers and a time delay and by an azimuth control block that also has variable amplitude scalers and time delays. An input audio signal is fed in to the range control block and the values of the scalers and the taps on the delay buffers are read out of look-up tables in a controller that is addressed by an azimuth index value corresponding to any location on a circle surrounding the headphone wearer. Several range control blocks and azimuth control blocks can be provided depending on the number of input audio signals to be located. All of the range and azimuth control is provided by the range control blocks and azimuth control blocks so that the resultant signals require only a fixed number of filters regardless of the number of input audio signals to provide the signal processing. Such signal processing is accomplished using front and back early reflection filters, left and right reverberation filters, and front and back azimuth filters having a head related transfer function.

12 Claims, 5 Drawing Sheets

| RANGE INDEX | DIRECT WAVE | RANGE 0 | RANGE DELAY (ms) |
|---|---|---|---|
| 0 | 0.000 | 0.000 | N/A |
| 1–20 | 1.000 | 0.000 | N/A |
| 21 | 0.900 | 0.050 | 50 |
| 22 | 0.850 | 0.100 | 49 |
| 23 | 0.820 | 0.130 | 48 |
| 24 | 0.790 | 0.170 | 47 |
| ⋮ | ⋮ | ⋮ | ⋮ |
| 119 | 0.080 | 0.835 | 1.5 |
| 120 | 0.040 | 0.890 | 0.0 |

| AZIMUTH INDEX | AMPLITUDE | | DELAY (ms) | |
|---|---|---|---|---|
| | LEFT | RIGHT | LEFT | RIGHT |
| 0 | 1.0 | 0.7071 | 0 | 600 |
| 1 | 1.0 | 0.7300 | 0 | 570 |
| 2 | 1.0 | 0.7530 | 0 | 540 |
| 3 | 1.0 | 0.7760 | 0 | 510 |
| ⋮ | ⋮ | ⋮ | ⋮ | ⋮ |
| 27 | 1.0 | 0.9310 | 0 | 90 |
| 28 | 1.0 | 0.9540 | 0 | 60 |
| 29 | 1.0 | 0.9770 | 0 | 30 |
| 30 | 1.0 | 1.0 | 0 | 0 |
| 31 | 0.9770 | 1.0 | 30 | 0 |
| 32 | 0.9540 | 1.0 | 60 | 0 |
| 33 | 0.9310 | 1.0 | 90 | 0 |
| ⋮ | ⋮ | ⋮ | ⋮ | ⋮ |
| 57 | 0.7760 | 1.0 | 510 | 0 |
| 58 | 0.7530 | 1.0 | 540 | 0 |
| 59 | 0.7300 | 1.0 | 570 | 0 |
| 60 | 0.7071 | 1.0 | 600 | 0 |
| 61 | 0.7300 | 1.0 | 570 | 0 |
| 62 | 0.7530 | 1.0 | 540 | 0 |
| 63 | 0.7760 | 1.0 | 510 | 0 |
| ⋮ | ⋮ | ⋮ | ⋮ | ⋮ |
| 87 | 0.9310 | 1.0 | 90 | 0 |
| 88 | 0.9540 | 1.0 | 60 | 0 |
| 89 | 0.9770 | 1.0 | 30 | 0 |
| 90 | 1.000 | 1.0 | 0 | 0 |
| 91 | 1.0 | 0.9770 | 0 | 30 |
| 92 | 1.0 | 0.9540 | 0 | 60 |
| 93 | 1.0 | 0.9310 | 0 | 90 |
| ⋮ | ⋮ | ⋮ | ⋮ | ⋮ |
| 116 | 1.0 | 0.7760 | 0 | 510 |
| 117 | 1.0 | 0.7530 | 0 | 540 |
| 118 | 1.0 | 0.7300 | 0 | 570 |
| 119 | 1.0 | 0.7071 | 0 | 600 |

*FIG. 4*

APPARATUS FOR CREATING 3D AUDIO IMAGING OVER HEADPHONES USING BINAURAL SYNTHESIS

BACKGROUND OF THE INVENTION

1. Field of the Invention

This invention relates generally to a sound image processing system for positioning audio signals reproduced over headphones and, more particularly, for causing the apparent sound source location to move relative to the listener with smooth transitions during the sound movement operation.

2. Description of Background

Due to the proliferation of sound sources now being reproduced over headphones, the need has arisen to provide a system whereby a more natural sound can be produced and, moreover, where it is possible to cause the apparent sound source location to move as perceived by the headphone wearer. For example, video games both based on the home personal computer and based on the arcade-type games generally involve video movement with an accompanying sound program in which the apparent sound source also moves. Nevertheless, as presently configured, most systems provide only a minimal amount of sound movement that can be perceived by the headphone wearer and, typically, the headphone wearer is left with the uncomfortable result that the sound source appears to be residing somewhere inside the wearer's head.

A system for providing sound placement during playback over headphones is described in U.S. Pat. No. 5,371,799 issued Dec. 6, 1994 and assigned to the assignee of this application. In that patent, a system is described in which front and back sound location filters are employed and an electrical system is provided that permits panning from left to right through 180° using the front filter and then from right to left through 180° using the rear filter. Scalers are provided at the filter inputs and/or outputs that adjust the range and location of the apparent sound source. This patented system requires a large number of circuit components and filtering power in order to provide the realistic sound image placement and in order to permit movement of the apparent sound source location using the front and back filters, a pair of which are required for the left and right ears.

At present there exists a need for a sound positioning system for use with headphones that can create three-dimensional audio imaging without requiring complex and expensive filtering systems, and which can permit panning of the apparent sound location for one or more channels or voices.

OBJECTS AND SUMMARY OF THE INVENTION

Accordingly, it is an object of the present invention to provide an apparatus for creating three-dimensional audio imaging during playback over headphones using a binaural synthesis approach.

It is another object of the present invention to provide apparatus for processing audio signals for playback over headphones in which an apparent sound location can be smoothly panned over a number of locations without requiring an unduly complex circuit.

It is another object of the present invention to provide an apparatus for reproducing audio signals over headphones in which a standardized set of filters can be provided for use with a number of channels or voices, so that only one set of filters is required for the system.

In accordance with an aspect of the present invention, the apparent sound location of a sound signal, as perceived by a person listening to the sound signals over headphones, can be accurately positioned or moved using azimuth placement filters, both front and back, and early sound reflection filters and a reverberation filter, all of which are controlled and ranged in azimuth using scalers or variable attenuators that are associated with each input signal and not with the filters themselves.

The above and other objects, features, and advantages of the present invention will become apparent from the following detailed description of illustrated embodiments, to be read in conjunction with the accompanying drawings in which like reference numerals represent the same or similar elements.

BRIEF DESCRIPTION OF THE DRAWINGS

FIG. 4 is an amplitude and delay table showing possible values for use in achieving the amplitude and ranging in the embodiment of FIG. 2;

DETAILED DESCRIPTION OF PREFERRED EMBODIMENTS

The present invention relates to a technique for controlling the apparent sound source location of sound signals as perceived by a person when listening to those sound signals over headphones. This apparent sound source location can be represented as existing anywhere in a circle of 0° elevation with the listener at the center of the circle.

Figures 1, 3:
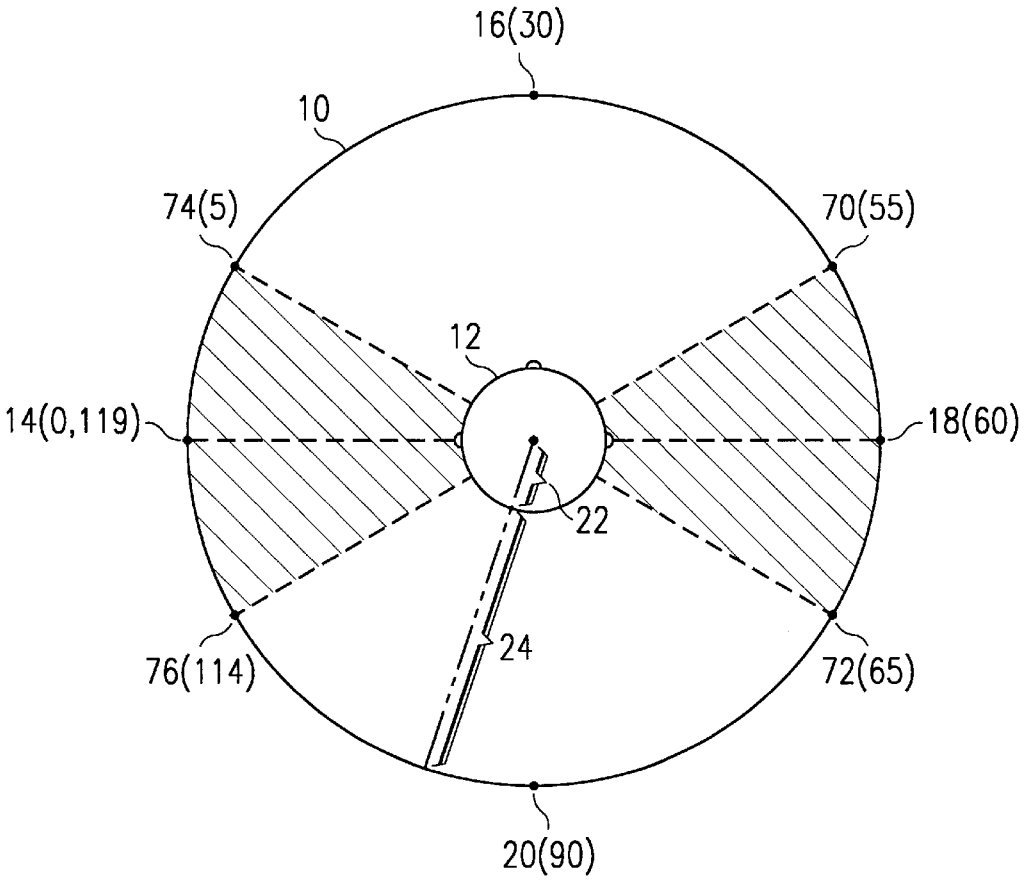
FIG. 1 is a representation of an auditory space with an azimuth and range shown relative to a headphone listener.
FIG. 3 is a chart showing values typically employed in a range look-up table used in the embodiment of FIG. 2.

FIG. 1 shows such circle 10 with the listener 12 shown generally at the center of the circle 10. Circle 10 can be arbitrarily divided into 120 segments for assigning azimuth control parameters. The location of a sound source can then be smoothly panned from one segment to the next, so that the listener 12 can perceive continuous movement of the sound source location. The segments are referenced or identified arbitrarily by various positions and, according to the present embodiment, position 0 is shown at 14 in alignment with the left ear of the listener 12 and position 30 is shown at 16 directly in front of the listener 12. Similarly, position 60 is at 18 aligned with the right ear of the listener 12 and position 90 is at the rear of the listener, as shown at point 20. Because the azimuth position parameters wrap around at value 119, the positions 0 and 119 are equivalent at point 14. The range or apparent distance of the sound source is controlled in the present invention by a range parameter. The distance scale is also divided into 120 steps or segments with a value 0 corresponding to a position at the center of the head of the listener 12 and value 20 corresponding to a position at the perimeter of the head of the listener 12, which is assumed to be circular in the interest of simplifying the analysis. The range positions from 0–19 are represented at 22 and the remaining range positions 21 through 120 correspond to positions outside of the head as represented at 24. The maximum range of 120 is considered to be the limit of auditory space for a given implementation and, of course, can be adjusted based upon the particular implementation.

Figure 2A:
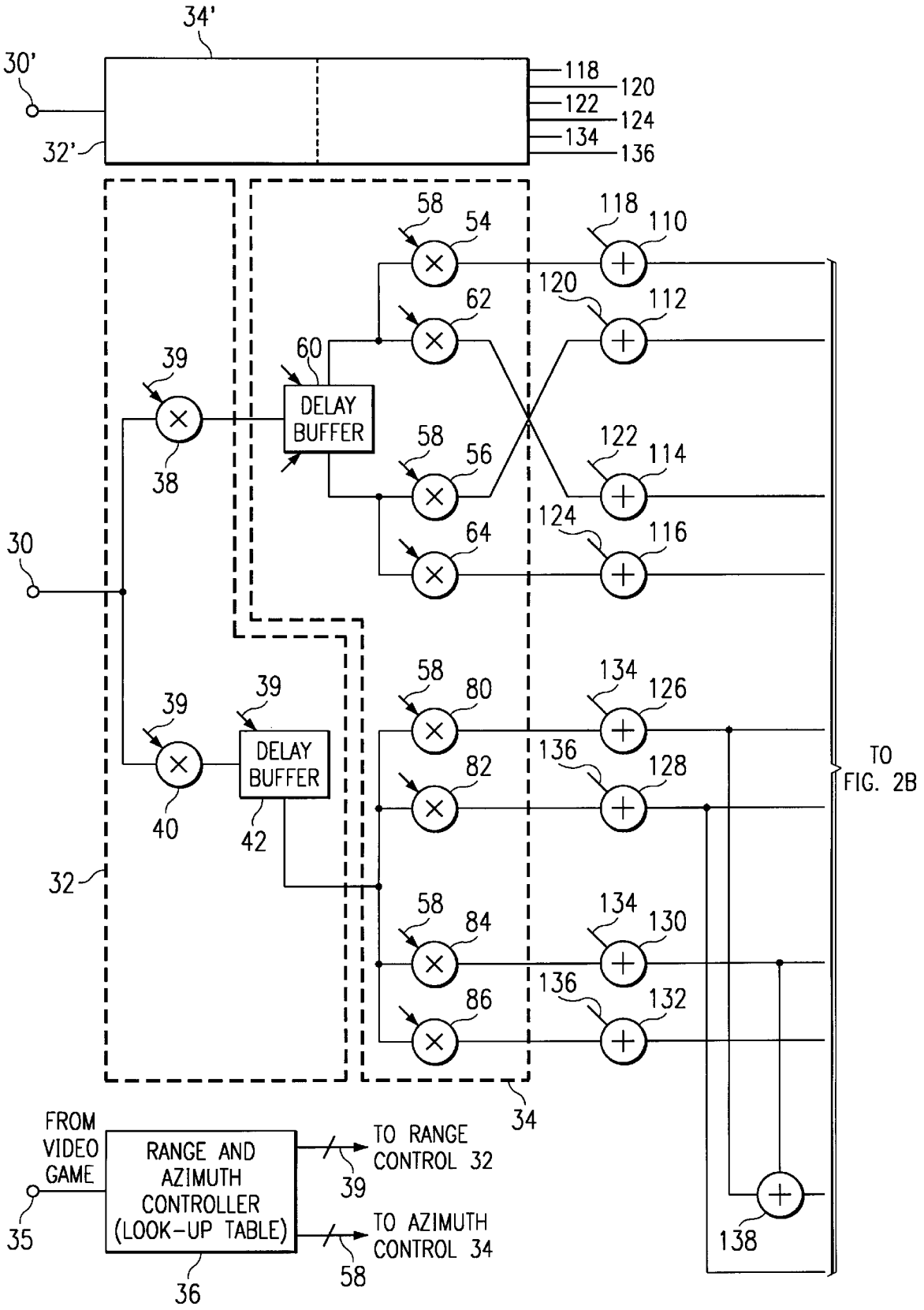
FIG. 2 is a schematic in block diagram form of a headphone processing system using binaural synthesis to produce localization of sound signals according to an embodiment of the present invention.
Figure 2B:
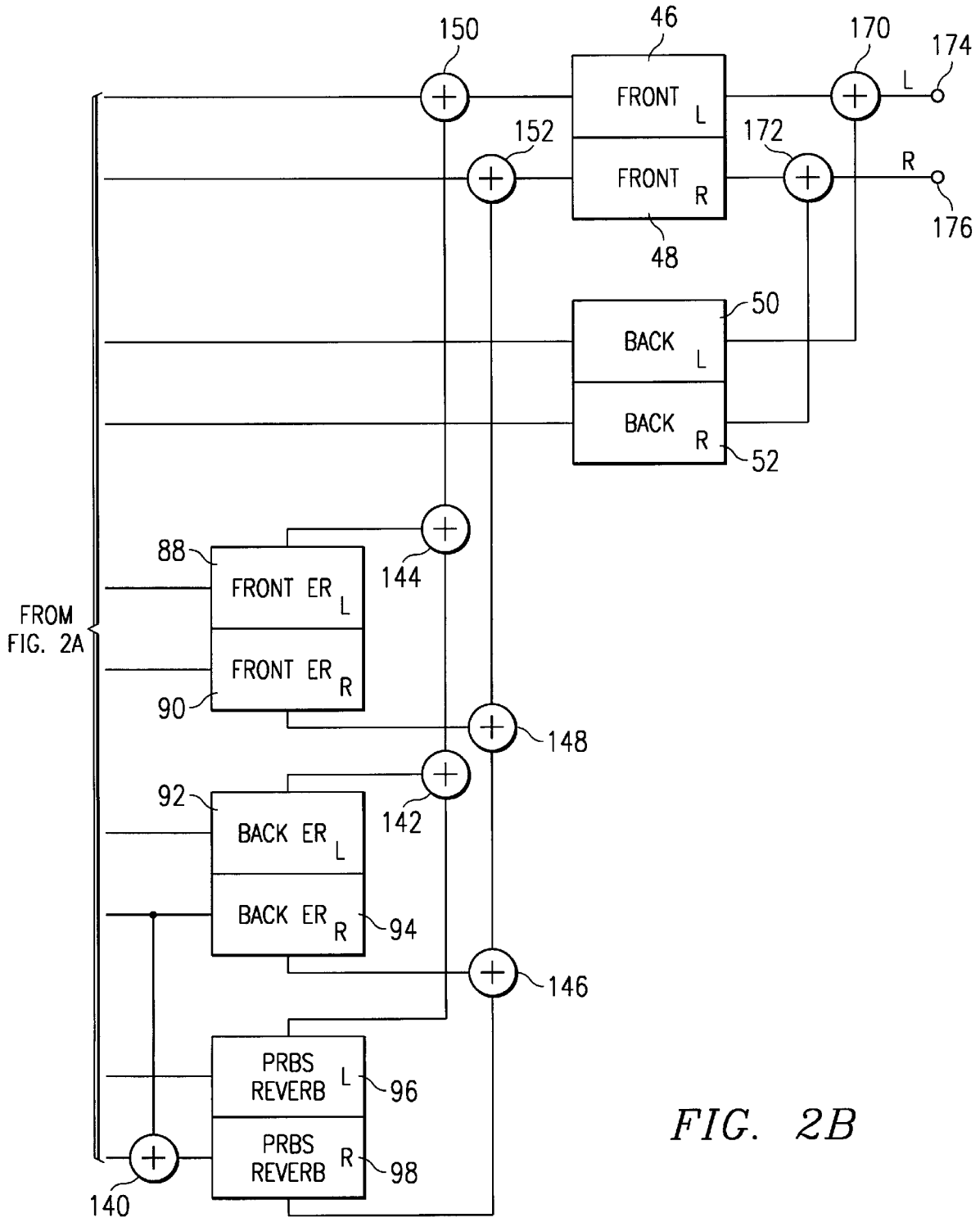

FIG. 2 is an embodiment of the present invention using a binaural synthesis process to produce sound localization anywhere in a horizontal plane centered at the head of a listener, such as the headphone listener 12 in FIG. 1. As is known, the sound emanating from a source in a room can be considered to be made up of three components. The first component is the direct wave representing the sound waves that are transmitted directly from the source to the listener's ears without reflecting off any surface. The second component is made up of the first few sound waves that arrive at the listener after reflecting off only one or two surfaces in the room. These so-called early reflections arrive approximately 10 ms to 150 ms after the arrival of the direct wave. The third component is made up of the remaining reflected sound waves that have followed a circuitous path after having been reflected off various room surfaces numerous times prior to arriving at the ear of the listener. This third component is generally referred to as the reverberant part of a room response. It has been found that a simulation or model of this reverberant component can be achieved by using a pseudo-random binary sequence (PRBS) with exponential attenuation or decay.

Referring to FIG. 2, an input audio signal is fed in at terminal 30 and is first passed through a range control block shown within broken lines 32 and then an azimuth control block shown within broken lines 34.

The range control block 32 employs a current value of the range parameter as provided by the video game program, for example, as an index input at 35 to address a look-up table employed in a range and azimuth controller 36. As will be explained, this range and azimuth controller 36 can take different forms depending upon the manner in which the present invention is employed. The look-up table consists of two scale factor values and one time delay value for each index or address in the table. These indexes correspond to the in-the-head range positions 0 through 20 shown at 22 in FIG. 1, and the out-of-the-head range positions 21 through 120, shown at 24 in FIG. 1. The input audio signal at terminal 30 is fed to a first scaler 38 that is used to scale the amount of signal that is sent through the azimuth processing portion of the embodiment of FIG. 2. The scaler 38 operates in response to a direct wave scale factor and a delay value as produced by the look-up table in the range and azimuth controller 36 and fed to scaler 38 on lines 39.

In that regard, FIG. 3 shows the look-up table of the range and azimuth controller 36 having representative scale factor values and time delays. The input audio signal is also fed to a second scaler 40 that forms a part of the range control block 32. This second scaler 40 is used to scale the amount of signal that is sent through the ranging portion of the embodiment of FIG. 2. The scaler 40 receives the ranged scale factor value and time delay on lines 39 from the look-up table, shown in FIG. 3, as contained within the range and azimuth controller 36. In other words, scaler 38 receives a direct wave value from the look-up table and the range delay value from the look-up table and, similarly, scaler 40 receives a ranged value and a range time delay as well from the look-up table represented in by FIG. 3 based on the range index fed in at input 35 of the range and azimuth controller 36.

The third element identified by the range index and obtained from the look-up table is a pointer to a delay buffer 42 that is part of the range control block 32. This pointer is produced by the range and azimuth controller 36, as read out from the look-up table and fed to delay buffer 42 on lines 39. This delay buffer 42 delays the signal sent to the range processing block 34 from anywhere between 0 to 50 milliseconds. This buffer 42 then adjusts the length of time between the direct wave and the first early reflection wave. The direct wave being the audio signal as scaled by scaler 38 and the first early reflection wave being the audio signal fed through scaler 40. As will be seen, as the range index increases the actual ranged time delay decreases. The minimum range index value outside the head of 21 is associated with the maximum time delay of 50 milliseconds, whereas the maximum range index value of 120 has the minimum delay of 0.0 milliseconds.

The azimuth control block 34 uses the current value of the azimuth parameter as produced by the range and azimuth controller 36 using a look-up table that contains the various azimuth values as represented in FIG. 4, for example, to establish the amount of signal sent to each side of the azimuth placement filters, which will be described hereinbelow.

The azimuth control block 34 uses the current value of the azimuth parameter to establish the amount of signal sent to each side of the azimuth placement filters, which in this embodiment include a left front filter 46, a right front filter 48, a left back filter 50 and a right back filter 52. Once again, the current azimuth parameter value is used as an index or address in a look-up table, shown in FIG. 4, that consists of pairs of left and right amplitude and delay entries. The first two columns in FIG. 4 relating to amplitude are used to set the scalers 54 and 56 that control how much signal is fed to the left and right sides 46 and 48 of the front azimuth placement filters. It is understood, of course, that these azimuth control values are fed out of the range and azimuth controller 36 on lines 58 and these values are represented by the arrows to scalers 54 and 56.

The second parameters contained within the look-up table forming a part of the range and azimuth controller 36 provide a time delay at the left and right sides of the front azimuth placement filter 46, 48 which delay is proportional to the current azimuth position as represented by the azimuth index 0–119 as shown in FIG. 4. This delay information shown in FIG. 4 is used to set the values of pointers in a delay buffer 60. As can be seen from the values in the table of FIG. 4, the signal sent to the right front azimuth filter 48 is delayed relative to the signal fed to the left front azimuth filter 46 for azimuth positions 0–29. For azimuth positions from 31–59 the signal sent to the left front azimuth filter 46 is delayed relative to the signal passing through the right side or the right front azimuth filter 48. If the azimuth value is greater than 60, keeping in mind that 60 represents the right side of the listener as shown FIG. 1, the sound signals are passed through the back azimuth placement filters represented by the left back azimuth filter 50 and the right back azimuth filter 52. This is accomplished by setting the scalers 54 and 56 to zero and applying the scale factor obtained from the look-up table, according to the current azimuth parameter value, to scalers 62 and 64, which control the amount of signal sent to the left back azimuth filter 50 and the right back azimuth filter 52. The value for the pointer into delay buffer 60 is obtained from the appropriate entry in the look-up table shown in FIG. 4 as described above and serves to delay one of the signals sent to the left back azimuth filter 50 or the right back azimuth filter 52. In this case, it is the signal fed to the right back filter 52 that is delayed. For azimuth positions 61–89, the signal passed to the left side of the back azimuth placement filter 50 is delayed relative to the right side. For azimuth positions from 91–119, the signal passed to the right back azimuth placement filter 52 is delayed relative to the signal fed to the left back azimuth filter 50.

According to the present invention, the use of the amplitude delay look-up table shown in FIG. 4, for example, in connection with the azimuth placement filters 46, 48, 50, and 52 is based on an approximation of the changes in the shape of the head related transfer function (HRTF) as a sound source moves from the position directly in front of the listener, such as point 16 in FIG. 1, to a position to the left or right of the listener, such as points 14 or 18 in FIG. 1. The sound waves from a sound source, of course, propagate to both ears of a listener and for sound directly in front of the listener, such as point 16 in FIG. 1, the signals reach the listener's ears at substantially the same time. As the sound source moves to one side, however, the sound waves reach the ear on that side of the head relatively unimpeded, whereas the sound waves reaching the ear on the other side of the head must actually pass around the head, thereby giving rise to what is known as the head shadow. This causes the sound waves reaching the shadowed ear to be delayed relative to the sound waves reaching the other ear that is on the same side of the head as the sound source. Moreover, the overall amplitude of the sound waves reaching the shadowed ear is reduced relative to the amplitude or sound wave energy reaching the ear on the same side as the sound source. This accounts for the change in amplitude in the left and right ears shown in FIG. 4.

In addition to such large magnitude changes there are other more subtle effects that affect the frequency content of the sound wave reaching the ears. These changes are caused partially by the shape of the human head but for the most part such changes arise from the fact that the sound waves must pass by the external or physical ears of the listener. For each particular azimuth angle of the sound source there are corresponding changes in the amplitude of specific frequencies at each of the listener's ears. The presence of these variations in the frequency content of the input signals to each ear is used by the brain in conjunction with other attributes of the input signals to the ear to determine the precise location of the sound source.

Therefore, it will be appreciated that in order to implement a binaural synthesis process for listening over headphones, it will be necessary to utilize a large number of head related transfer functions to achieve the effect of assigning an input sound signal to any given location within a three-dimensional space. Typically, head related transfer functions are implemented using a finite impulse response filter (FIR) of sufficient length to capture the essential components needed to achieve realistic sound signal positioning. Needless to say, the cost of signal processing using such an approach can be so excessive as to generally prohibit a mass-market commercial implementation of such a system. According to the present invention, in order to reduce the processing requirements of such a large number of head related transfer functions, the FIR's are shortened in length by reducing the number of taps along the length of the filter. Another simplification according to the present invention is the utilization of a smaller number of head related transfer function filters by using filters that correspond to specific locations and then interpolating between these filters for intermediate positions. Although these proposed methods do, in fact, reduce the cost, there still remains a significant amount of signal processing that must be performed. The present invention provides an approach not heretofore suggested in order to obtain the necessary cues for azimuth position in binaural synthesis.

The present inventors have determined that the human brain determines azimuth being heavily dependent on the time delay and amplitude difference between the two ears for the sound source somewhere to one side of the listener. Using this observation, an approximation of the head related transfer functions was implemented that relies on using a simple time delay and amplitude attenuation to control the perceived azimuth of a source location directly in front of a listener. The present invention incorporates a generalized head related transfer function that corresponds to a sound source location directly in front of the listener and this generalized head related transfer function provides the main features relating to the shadowing effect of the head. Then, to synthesize the azimuth location for a sound source, the input signal is split into two parts. One of the signals obtained by the splitting is delayed and attenuated according to the value stored in the amplitude and delay table represented in FIG. 4, and this is passed to one side of an azimuth placement filter as represented by the filters 46, 48, 50, and 52 in FIG. 2. The other signal obtained by the split is passed unchanged to the other side of the same azimuth placement filter that the attenuated and delayed signal was passed to. In this way a sound image is caused to be positioned at the desired location. The azimuth placement filter then alters the frequency content of both signals to simulate the effects of the sound passing by the head. This results in a significant reduction in processing requirements yet still provides an effective perception of the azimuth attributes of the localized sound source.

Referring back to FIG. 1, an improvement with respect to the crossover point between the front and back azimuth positions would be to introduce a cross fading region at either side of azimuth positions 0 and 60, that is, points 14 and 18 respectively in FIG. 1. For example, over a range of eleven azimuth positions, the signals to be processed by the front and back azimuth filters 46, 48 and 50, 52 are cross faded to provide a smooth transition between the front and back azimuth locations. For example, in FIG. 1, starting at azimuth position 55 at point 70, the signal is divided so that most of the signal goes to the front azimuth filter 46, 48 and a small amount of the signal goes to the back azimuth filter 50, 52. At azimuth position 60 shown at point 18, equal amounts of the signal are sent to the front filters 46, 48 and back filters 50, 52. At azimuth position 65 shown at point 72 most of the signal goes to the back filters 50, 52 and a small amount of the signal goes to the front azimuth placement filters 46, 48. This improves the transition from a front azimuth position to a back azimuth position and the use of five steps on either side of the direct position 60 is an arbitrary number and can be more or less depending upon the accuracy of sound image placement and granularity that can be tolerated. Of course, this approach also applies to the crossover region at the left side at azimuth points 0 and 119 shown at point 14. In that regard, the cross fade could start at azimuth position 5 shown at 74 and end at azimuth position 114 shown at 76.

The range and azimuth controller 36 of FIG. 2 is also employed to determine the value of the scalers employed in the early reflection and reverberation filters. More specifically, the range and azimuth controller 36 provides values or coefficients on lines 58 to the azimuth control section 34. Specifically, the coefficients are fed to the scalers 80, 82, 84, and 86 to set the amount of signal forwarded to the early reflection filters that comprise the left front early reflection filter 88, the right front early reflection filter 90, the left back early reflection filter 92, and the right back early reflection filter 94. More particularly, the signal obtained from delay buffer 42 is divided and sent to the early reflection filters 88, 90, 92, 94 and is also sent to the reverberation filters that comprise the pseudo-random binary sequence filters with exponential decay, in which the left filter is shown at 96 and the right filter is shown at 98 in FIG. 2.

For azimuth positions between 0 and 59, as represented in FIG. 1, the scalers 80 and 82 are set according to the current azimuth parameter value as derived from the amplitude and delay chart shown in FIG. 4. That is, one of the scalers 80 and 82 is set to 1.0 while the other scaler is set to a value between 0.7071 and 1.0, depending on the actual azimuth value. If the current azimuth setting is from 0 to 29, the scaler 80 is set to 1.0 and the scaler 82 is set to a value between 0.7071 and 1.0. If the azimuth setting is between 31 and 59 as represented in FIG. 1, then scaler 82 is set to 1.0 and the scaler 80 is set to a value between 0.7071 and 1.0. Similarly, the scalers 84 and 86 are both set to 0 if the azimuth setting is less than 61, that is, if there is no location of the sound source corresponding to the back position of FIG. 1. For azimuth settings greater than 60 a similar approach as described above is used to set scalers 84 and 86 to the appropriate nonzero values, while the scalers 80 and 82 are set to 0. For example, if the current azimuth setting is from 61 to 89, the scaler 86 is set to 1.0 and the scaler 84 is set to a value between 0.7071 and 1.0. If the azimuth setting is between 91 and 119, the scaler 84 is set to 1.0 and the scaler 86 is set to a value between 0.7071 and 1.0.

By providing values for scalers as described above, it is insured that an input sound signal intended for the front half is processed through the left and right front early reflection filters 88 and 90 and an input signal intended for the back is processed through the left and back early reflection filters 92 and 94.

The above-described system for determining the values of scalers 80, 82, 84, 86 using the amplitude for the left and right sides as shown in FIG. 4 permits a method for setting the amount of sound passed to each side of the front and rear early reflection filters 88, 90, 92, and 94 that is independent of the system used to send the signal to the azimuth placement filters 46, 48, 50, and 52. More specifically, a different amplitude table can be used to scale the signal sent to each side of the early reflection filters 88, 90, 92, and 94 than is used in the case of the azimuth placement filters 46, 48, 50, 52. Moreover, this system can be further simplified if desired in the interests of economy such that the values used for the scalers 54, 62, 56, and 64 can also be used as the values for the scalers 80, 84, 82, and 86. More particularly, the value for scaler 80 is set to the value for the scaler 54, the value for scaler 82 is set to the value for scaler 56, the value for scaler 84 is set to the value for scaler 62, and the value for scaler 86 is set to the value for scaler 64.

The present invention contemplates that more than one input signal, in addition to the one signal shown at 30, might be available to be processed by the present invention, that is, there may be additional parallel channels having audio signal input terminals similar to terminal 30 such as terminal 30'. These parallel channels might be different voices or sounds or instruments or any other kind of different audio input signals. Nevertheless, according to this embodiment of the present invention, it is not necessary to provide a complete set of filters for each input channel. Rather, all that is required is the azimuth and range processing blocks, as shown at 32 and 34, be provided for each input channel such as 32' and 34' for terminal 30'. Thus, signal summers or adders 110, 112, 114, and 116, are provided for combining additional input sound signals fed in on lines 118, 120, 122, 124, respectively, to be processed through the left and right front azimuth filters 46, 48, and left and right back azimuth filters 50, 52. Azimuth and range control blocks 32 and 34 are then provided for each additional input sound signal. Summers 110, 112 add signals from these other input control blocks that are destined for the left and right sides of the front azimuth placement filter 46, 48, respectively. Similarly, summers 114 and 116 add signals on lines 122 and 124 from the other input control blocks that are destined for the left and right sides of the back azimuth placement filter 50, 52, respectively.

In keeping with this approach, summers 126, 128, 130, 132 combine additional input sound signals for processing through the front early reflection filters 88 and 90, the back early reflection filters 92, 94 and the reverberation filters 96, 98. More specifically, summers 126 and 128 add signals on lines 134 and 136, respectively, from other azimuth and range control blocks that are destined for the left and right sides of the front early reflection filters 88, 90, respectively. Summers 130 and 132 add signals on lines 134 and 136, respectively, from other input control blocks that are destined for the left and right sides of the back early reflection filters 92, 94, respectively.

The signal for the left front early reflection filter 88 is added to the signal for the left back early reflection filter 92 in summer 138 and is fed to the left reverberation filter 96. The signal for the right front early reflection filter 90 is added to the signal for the right back early reflection filter 94 in summer 140 and fed to the right reverberation filter 98. The left and right reverberation filters 96 and 98 produce the reverberant or third portion of the simulated sound as described above.

The front early reflection filters 88, 90 and the back early reflection filters 92, 94 according to this embodiment can be made up of sparsely spaced spikes that represent the early sound reflections in a typical real room. It is not a difficult problem to arrive at a modeling algorithm using the room dimensions, the position of the sound source, and the position of the listener in order to calculate a relatively accurate model of the reflection path for the first few sound reflections. In order to provide reasonable accuracy, calculations in the modeling algorithm take into account the angle of incidence of each reflection, and this angle is incorporated into the amplitude and spacing of the spikes in the finite impulse response filter (FIR). The values derived from this modeling algorithm are saved as a finite impulse response filter with sparse spacing of the spikes and, by passing part of the sound signals through this filter, the early reflection component of a typical room response can be created for the given input signal.

Figure 5:
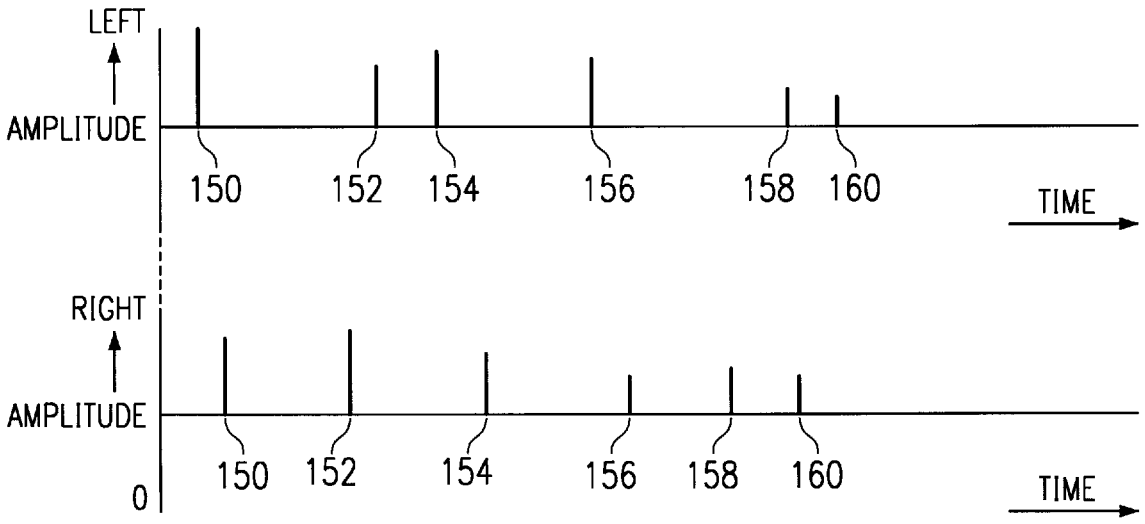
FIG. 5 is a representation of six early reflections in an early reflection filter as used in the embodiment of FIG. 2.

FIG. 5 represents the spikes present in such an early reflection filter as might be derived in a typical real room and, in this case, the spikes represent the six reflections of various respective amplitudes as time progresses from the start of the sound signal. FIG. 5 shows six such early reflection sound spikes. FIG. 5 is an example of an early reflection filter based on the early reflection modeling algorithm and shows six reflections as matched pairs between the left and right sides of the room filter, for example, the first reflection is shown at 150, the second reflection at 152, the third reflection at 154, the fourth reflection at 156, the fifth reflection at 158, and the sixth reflection at 160. These spikes, of course, are represented as the amplitude of the early reflection sound signal plotted against time. The use of six early reflections in this example is arbitrary, and a greater or lesser number could be used.

Figure 6:
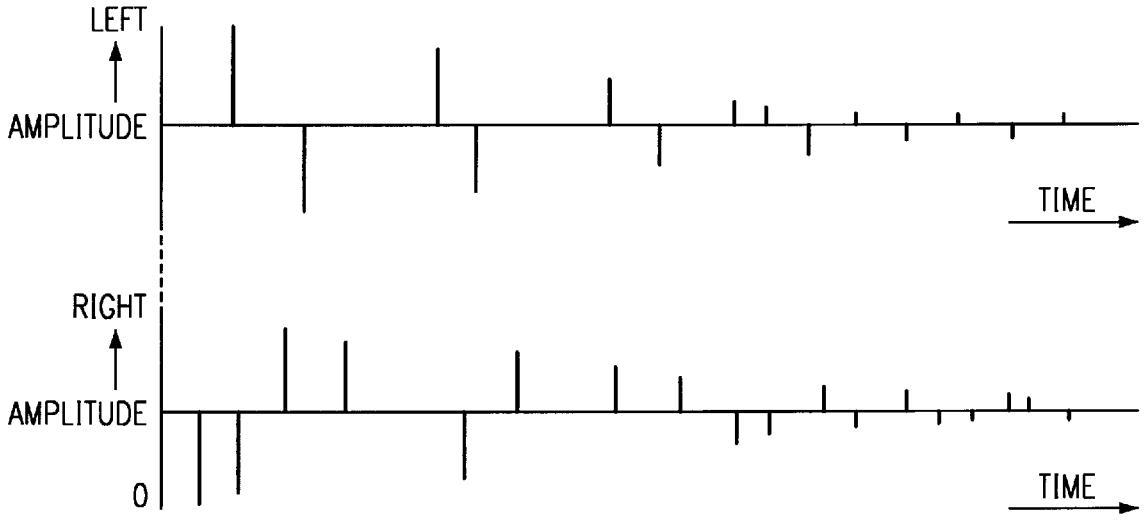
FIG. 6 is a representation of the output of the reverberation filters used in the embodiment of FIG. 2.

FIG. 6 represents the nature of the pseudo-random binary sequence filter that is used to provide the reverberation effects making up the third component of the sound source as taught by the present invention. FIG. 6 shows a portion of the pseudo-random binary sequence filters 96 and 98 used to generate the tail or reverberant portion of the sound processing. As will be noted, the spikes are shown decreasing in amplitude as time increases. This, of course, is the typical exponential reverberant sound in a closed box or the like. The positive or negative going direction of each spike is random and there is no inherent significance to the fact that some of the spikes are represented as minus voltage or negative going amplitude.

The outputs from the reverberation filters 96 and 98 are added to the outputs from the early reflection filters to create the left and right signals. Specifically, the output of the left reverberation filter 96 is added to the output of the left back early reflection filter 92 in a summer 142 whose output is then added to the output of the left front early reflection filter 88 in summer 144. Similarly, the output from the right reverberation filter 98 is added to the right back early reflection filter output 94 in summer 146 whose output is then added to the right front early reflection filter 90 output in summer 148.

The resulting signals from summers 144, 148 are added to the signals from summers 110, 112 at summers 150, 152, respectively to form the inputs to the front azimuth placement filters 46, 48. Thus, all of the sound wave reflections, as represented by the early reflection filters 88, 90, 92, and 94 and the reverberation filters 96, 98 are passed through the azimuth placement filters 46, 48. This results in a more realistic effect for the ranged portion of the processing. As an approach to cutting down on the number of components being utilized, the summers 110 and 150, 144 and 142 could be replaced by a single summer although the embodiment shown in FIG. 2 employs four individual components in order to simplify the circuit diagram. Similarly, summers 112, 152, 148, and 146 could be replaced by a single unit. In addition, as a further alternate arrangement, the output from the back early reflection filters 92, 94 could be fed to the input to the back azimuth placement filters 50 and 52, and the output from the reverberation filters 96, 98 could be fed to the inputs of the back azimuth placement filters 50, 52.

The front azimuth placement filter 46, 48 is based on the head related transfer function obtained by measuring the ear inputs for a sound source directly in front of a listener at 0° of elevation. This filter can be implemented as a FIR with a length from approximately 0.5 milliseconds up to 5.0 milliseconds dependent upon the degree of realism that is desired to be obtained. In the embodiment shown in FIG. 2 the length of the FIR is 3.25 milliseconds. As a further alternative, the front azimuth placement filters 46, 48 can be modeled using an infinite impulse response filter (IIR) and can be thereby implemented to effect cost savings. Similarly, the back azimuth placement filter 50, 52 is based upon the head related transfer function obtained by measuring the ear input signals for a sound source directly behind a listener at 0° of elevation. While this filter is also implemented as an FIR having a length of 3.25 milliseconds, it could also employ the range of lengths described relative to the front azimuth placement filter 46, 48. In addition, the back azimuth placement filters 50, 52 could be implemented as IIR filters.

In forming the output signals then, the left and right outputs from the front and back azimuth placement filters are respectively added in signal adders 170 and 172 to form the left and right output signals at terminals 174 and 176. Thus, the output signals at terminals 174 and 176 are played back or reproduced using headphones so that the headphone wearer can hear the localization effects created by the circuitry shown in FIG. 2.

Although the embodiment shown and described relative to FIG. 2 uses a combination of two azimuth placement filters and two early reflection filters, that is, a front and back for each filter type, the present invention need not be so restricted and additional azimuth placement filters and early reflection filter could be incorporated following the overall teaching of the invention. Appropriate changes to the range and azimuth control blocks would then accommodate the additional azimuth placement filters and/or additional early reflection filters.

Furthermore, the amplitude and delay tables can be adjusted to account for changes in the nature of the azimuth placement filters actually used and such adjustment to the look-up tables would maintain the perception of a smoothly varying azimuth position for the headphone listener.

Moreover, the range table can also be adjusted to alter the perception of the acoustic space created by the invention. This look-up table may be adjusted to account for the use of a different room model for the early refections. It is also possible to use more than one set of room models and corresponding range table in implementing the present invention. This would then accommodate the need for different size rooms as well as rooms with different acoustic properties.

Although the present invention has been described hereinabove with reference to the preferred embodiment, it is to be understood that the invention is not limited to such illustrative embodiment alone, and various modifications may be contrived without departing from the spirit or essential characteristics thereof, which are to be determined solely from the appended claims.

What is claimed is:

1. Apparatus for creating 3D audio imaging over headphones:

range control means receiving an audio input signal for producing therefrom a ranged signal and an unranged signal;

azimuth control means receiving said ranged signal and said unranged signal from said range control means for producing respectively therefrom a plurality of amplitude scaled ranged signals and a plurality of amplitude scaled unranged signals;

front and back early reflection filter means receiving said plurality of amplitude scaled ranged signals from said azimuth control means for producing left and right front early reflection signals and left and back rear early reflection signals;

reverberation processing means receiving said plurality of amplitude scaled ranged signals from said azimuth control means for producing therefrom left and right reverberation signals;

first means for adding said left front early reflection signal, said left back early reflection signal, and said left reverberation signal, with a first one of said plurality of amplitude scaled unranged signals from said azimuth control means to produce a left summed signal;

second means for adding said right front early reflection signal, said right back early reflection signal, and said right reverberation signal with a second one of said plurality of amplitude scaled unranged signals from said azimuth control means to produce a right summed signal;

front azimuth filter means receiving said left summed signal and said right summed signal for producing therefrom left and right front processed signals;

back azimuth filter means receiving third and fourth ones of said plurality of amplitude scaled unranged signals and producing therefrom left and right back processed signals; and third means for adding said left front processed signal and said left back processed signal for producing a left channel headphone signal and for adding said right front processed signal and said right back processed signal for producing a right channel headphone signal.

2. The apparatus for creating 3D audio imaging over headphones according to claim 1, wherein said front azimuth filter means includes a front head related transfer function and said back azimuth filter means includes a back head related transfer function.

3. The apparatus for creating 3D audio imaging over headphones according to claim 1, wherein said reverberation processing means includes a pseudo random binary sequence filter having an exponential decay.

4. The apparatus for creating 3D audio imaging over headphones according to claim 1, further comprising:

fourth means for adding respectively a second plurality of amplitude scaled ranged signals associated with a second range control means and a second azimuth control means to said plurality of amplitude scaled ranged signals from said azimuth control means for providing composite ranged signals to said front and back early reflection filter means and said reverberation processing means; and fifth means for adding respectively a second plurality of amplitude scaled unranged signals to said plurality of amplitude scaled unranged signals from said azimuth control means for providing composite unranged signals fed to said first and second means for adding.

5. The apparatus for creating 3D audio imaging over headphones according to claim 1, wherein said range control means comprises a first range amplitude scaler, a second range amplitude scaler, and a delay buffer, and further comprising a range and azimuth controller for providing amplitude scale values to said first and second range amplitude scalers and a delay value to said delay buffer in response to an azimuth index signal fed thereto, wherein an output of said first range amplitude scaler forms said unranged signal from said range control means, and an output of said second range amplitude scaler is fed to said delay buffer and an output of said delay buffer forms said ranged signal from said range control means.

6. The apparatus for creating 3D audio imaging over headphones according to claim 1, wherein said azimuth control means comprises a delay buffer receiving said unranged signal from said range control means and producing outputs fed to a first plurality of azimuth scalers, and a second plurality of azimuth scalers each receiving said ranged signal from said range control means and further comprising a range and amplitude controller for providing delay values to said delay buffer and amplitude scale values to said first and second plurality of azimuth scalers in response to an azimuth index signal fed thereto and wherein outputs of said first plurality of azimuth scalers form said plurality of amplitude scaled unranged signals from said azimuth control means and outputs of said second plurality of azimuth scalers form said plurality of amplitude scaled range signals from said azimuth control means.

7. The apparatus for creating 3D audio imaging over headphones according to claim 1, wherein:

said range control means comprises a first range amplitude scaler, a second range amplitude scaler, and a first delay buffer, wherein an output of said first range amplitude scaler forms said unranged signal from said range control means, and an output of said second range amplitude scaler is fed to said first delay buffer and an output of said first delay buffer forms said ranged signal from said range control means;

said azimuth control means comprises a second delay buffer receiving said unranged signal from said range control means and producing outputs fed to a first plurality of azimuth scalers, and a second plurality of azimuth scalers each receiving said ranged signal from said range control means, wherein outputs of said first plurality of azimuth scalers form said plurality of amplitude scaled unranged signals from said azimuth control means and outputs of said second plurality of azimuth scalers form said plurality of amplitude scaled ranged signals from said azimuth control means; and further comprising a range and azimuth controller for providing amplitude scale values to said first and second range amplitude scalers, a delay value to said first delay buffer, delay values to said second delay buffer, and amplitude scale values to said first and second plurality of azimuth scalers in response to an azimuth index signal fed thereto.

8. Apparatus for locating an apparent source of a sound to a listener using headphones, comprising:

first range and azimuth control means receiving a first input audio signal and producing therefrom first left and right front unranged azimuth signals and first left and right back unranged azimuth signals, and a first plurality of ranged signals;

second range and azimuth control means receiving a second input audio signal and producing therefrom second left and right front unranged azimuth signals and second left and right back unranged azimuth signals, and a second plurality of ranged signals;

signal adding means for respectively adding second left and right front unranged azimuth signals to said first left and right front unranged azimuth signals to produce left and right front composite signals, for respectively adding second left and right back unranged azimuth signals to said first left and right back unranged azimuth signals to produce left and right back composite signals, and for respectively adding a second plurality of ranged signals to said first plurality of ranged signals to produce a plurality of composite ranged signals;

early reflection filter means receiving said plurality of composite ranged signals for producing therefrom left and right front early reflection signals and left and right back early reflection signals;

reverberation processing means receiving said plurality of composite ranged signals for producing left and right reverberation signals;

front azimuth filter means receiving said left and right front composite signals, said left and right front early reflection signals, said left and right back early reflection signals for producing left and right front azimuth signals in accordance with a head related transfer function;

back azimuth filter means receiving said left and right back composite signals for producing left and right back azimuth signals in accordance with the head related transfer function; and means for combining said left front azimuth signal and said left back azimuth signal to form a left channel headphone signal and for combining said right front azimuth signal and said right back azimuth signal to form a right channel headphone.

9. The apparatus for locating an apparent source of a sound to a listener using headphones according to claim 8, wherein said reverberation processing means includes a pseudo random binary sequence filter having an exponential decay.

10. Apparatus for locating a source of a sound in range and azimuth around a listener of the sound using headphones, comprising:

range and azimuth control means including a plurality of variable amplitude scalers and a plurality of variable length delay buffers for producing from an input audio signal a plurality of amplitude scaled ranged signals and a plurality of amplitude scaled unranged signals;

a controller connected to said range and azimuth control means and having stored therein amplitude scale values and delay values, said amplitude scale values setting said variable amplitude scalers and said delay values setting said delay buffers in response to an azimuth index signal fed to said range and azimuth controller;

front and back early reflection filter means receiving said plurality of amplitude scaled ranged signals from said range and azimuth control means for producing left and right front early reflection signals and left and right back early reflection signals;

reverberation processing means receiving said plurality of amplitude scaled ranged signals from said range and azimuth control means for producing therefrom left and right reverberation signals;

front azimuth filter means receiving first and second ones of said plurality of amplitude scaled unranged signals, said left and right front early reflection signals, and said left and right reverberation signals for producing therefrom left and right front azimuth signals;

back azimuth filter means receiving third and fourth ones of said plurality of unranged signals for producing therefrom left and right back azimuth signals; and means for combining said left front azimuth signal and said left back azimuth signal to form a left channel headphone signal and for combining said right front azimuth signal and said right back azimuth signal to form a right channel headphone signals.

11. The apparatus according to claim 10, wherein said front azimuth filter means includes a front head related transfer function and said back azimuth filter means includes a back head related transfer function.

12. The apparatus according to claim 10, wherein said reverberation processing means includes a pseudo random binary sequence filter having an exponential decay.

* * * * *